US006144394A

United States Patent [19]

Ogawa et al.

[11] Patent Number: 6,144,394

[45] Date of Patent: Nov. 7, 2000

[54] IMAGE FORMING METHOD AND DEVICE

[75] Inventors: Katsutoshi Ogawa, Hirakata; Yoshitaka Kitaoka, Kadoma; Akira Kumon, Katano; Masahiro Aizawa, Takatsuki; Hiroyuki Matsuo, Neyagawa; Akira Fukano, Ikoma; Akira Ryoji, Osaka, all of Japan

[73] Assignees: Matsushita Electric Industrial Co., Ltd., Osaka, Japan; Array Printers AB, Västra Frölunda, Sweden

[21] Appl. No.: 09/288,827

[22] Filed: Apr. 8, 1999

[30] Foreign Application Priority Data

Apr. 13, 1998 [JP] Japan ..... 10-100780

[51] Int. Cl.[7] ..... B41J 2/385; B41J 2/415

[52] U.S. Cl. ..... 347/140; 347/55; 347/124

[58] Field of Search ..... 347/140, 151, 347/55, 124; 399/291

[56] References Cited

U.S. PATENT DOCUMENTS

| | | | |
|---|---|---|---|
| 4,478,510 | 10/1984 | Fujii et al. . | |
| 4,491,855 | 1/1985 | Fujii et al. . | |
| 4,755,837 | 7/1988 | Schmidlin et al. | 347/55 |
| 5,170,185 | 12/1992 | Takemura et al. | 347/55 |
| 5,726,695 | 3/1998 | Ueda | 347/55 |

FOREIGN PATENT DOCUMENTS

| | | |
|---|---|---|
| 266960 | 5/1988 | European Pat. Off. . |
| 44-26333 | 11/1969 | Japan . |
| 58-104769 | 6/1983 | Japan . |
| 58-211464 | 12/1983 | Japan . |
| 3-211064 | 9/1991 | Japan . |
| 4-292958 | 10/1992 | Japan . |
| 4-329154 | 11/1992 | Japan . |
| 7-164669 | 6/1995 | Japan . |
| 8-192527 | 7/1996 | Japan . |
| 8-192528 | 7/1996 | Japan . |
| 90-14959 | 12/1990 | WIPO . |
| 98-07571 | 2/1998 | WIPO . |

*Primary Examiner*—Susan S. Y. Lee
*Attorney, Agent, or Firm*—Price and Gess

[57] ABSTRACT

In an image forming device wherein printing is accomplished such that passing of charged toners fed from a developer roller 2 through a plurality of openings 14 is controlled by control electrodes 16 of an aperture electrode 12 in accordance with image signals, toners held on the developer roller 2 are caused to reach the vicinity of the openings 14, by inputting a predetermined signal to the control electrodes 16 of the aperture electrode 12, at least once during the period when no image forming action in accordance with the prescribed image signals is performed.

19 Claims, 11 Drawing Sheets

IMAGE FORMING METHOD AND DEVICE

BACKGROUND OF THE INVENTION

1. Technical Field of the Invention

The present invention relates to an image forming device such as copier, facsimile machine, and printer, and more particularly, to a cleaning process in an image forming method for recording images by ejecting toners onto a recording member.

2. Description of Related Art

As the capacity of personal computers has been increased in recent years, a great mass of documents are now handled in offices. Also, in accordance with the progress in network technologies, printers and copiers of high processing ability have come into wide use. Meanwhile, the recent trend is towards color documents with the rapid spread of ink jet printers or the like. However, an image forming device that is capable of outputting satisfying monotone images as well as color documents at high speed is still being developed and realization of such device is awaited. Below, explanation is made with reference to figures showing prior art image forming devices.

FIG. 7 is a schematic illustration showing the construction of an electric signal recording method disclosed in Japanese Published Examined Patent Application 44-26333. Reference numerals 71, 72, 73, 74, 75, 76, 77 in the figure respectively represent a backside electrode, recording medium, control grid, mesh electrode, toners, brush, and power supply. Toners 75 are tribo-electrically charged to acquire, for example, negative charges by rotation of the brush 76. Between the mesh electrode 74 and backside electrode 71 is connected the power supply 77 for creating an electric field by which charged toners 75 are accelerated towards the recording medium 72. By providing electric signals 78 across the mesh electrode 74 and control grid 73, the amount of toners passing through the mesh electrode 74 and the position of toners adhering on the recording medium 72 can be controlled in accordance with the polarity and strength of the inputted signals. Specifically, when "on" signal as the electric signal 78 is inputted to the control grid 73 (which means that positive polarity is given in the case of toners 75 having negative charges), the gate is opened, whereupon toners 75 travel in the parallel electric field formed between the mesh electrode 74 and backside electrode 71 by means of the power supply 77 in the direction of recording medium 72. Conversely, when "off" signal as the electric signal 78 is inputted (which means that negative polarity is given in the case of toners 75 having negative charges), the gate is closed and toners cannot pass through the control electrode 73. In this way, an image is recorded by the combination of electric signals "on" and "off".

FIG. 8 is a schematic illustration showing the construction of another prior art image recording device disclosed in Japanese Published Unexamined Patent Application 58-104769. In FIG. 8, signal electrodes 101, base electrodes 103, and insulating members 102 interposed therebetween, are disposed such as to surround an aperture (gate) 104. Reference numeral 105 is a recording member, and 106 is a backside electrode that is connected to a source of direct current voltage 109 and a voltage of about 300V is impressed thereto. 107 is a toner conveying member, 108 is a source of alternating current voltage, 110 is a signal power supply, that is connected to the signal electrodes 101 and base electrodes 103 for impressing a voltage of 50V thereto for recording. 111 is a mono-component insulating magnetic toner powder, 112 is a fixed magnet, and 114 is a magnetic blade.

Next, actions of this image recording device will be explained. A thin layer of mono-component insulating magnetic toner powder 111 is formed on the toner conveying member 107 by means of the magnetic blade 114. Alternating current, either solely or overlapped with a direct current, is applied across the base electrodes 103 and toner conveying member 107, as a result of which the mono-component insulating magnetic toners 111 begin a reciprocating motion. Then, recording signals are inputted to the signal electrodes 101 and a voltage of forward polarity is applied thereto, upon which the mono-component insulating magnetic toners 111 pass through the aperture 104, travel along the electric field created by the backside electrode 106, and adhere to the recording member thereby accomplishing image formation. Conversely, when no voltage is applied to the signal electrodes 101, or, in case that a voltage of opposite polarity is applied thereto, the mono-component insulating magnetic toners 111 do not pass through the aperture 104 and image formation is not performed. In the arrangement shown in FIG. 8, a high voltage is impressed to the backside electrode 106 during the non-image formation period, thereby causing toners which remain in the aperture to eject; it is thus prevented that the aperture becomes clogged up with toners.

Above described conventional image forming devices are, however, subjected to the following problems.

(1) In the method disclosed in Japanese Published Examined Patent Application 44-26333 wherein the gate to the parallel electric field formed between the mesh electrode and backside electrode is opened and closed by means of electric signals inputted to the control grid, the mesh electrode and control grid must be sufficiently distanced with each other, so that open/close signals generated by the control grid are effected without failure. If the mesh electrode and control grid were to be disposed in the vicinity or in contact with each other, electric signals would have to have a great voltage differential, which would necessitate the use of switching elements of high voltage, leading to increase in size of the device itself and in cost. On the contrary, if the spacing between the mesh electrode and control grid is too great, because controllability of flying toners will decrease, and even the basic performance required for the device such as forming favorable images can hardly be achieved.

(2) In the system where signal electrodes and base electrodes are formed on both sides of insulating members as set forth in Japanese Published Unexamined Patent Application 58-104769, lines of electric force along which toners are ejected are intensively formed between the signal electrodes and base electrodes, wherefore toners tend to stick to the wall surface of the aperture and the aperture is easily clogged up with toners.

(3) As a countermeasure for this, a high voltage electric field is created across the signal electrodes and backside electrode. However, application of a high voltage in the area where electrodes are adjacent with each other causes serious problems such as discharge destruction and damage to the signal electrodes, whereby reliability is considerably decreased.

BRIEF SUMMARY OF THE INVENTION

In view of the foregoing, an object of the present invention is to provide an image forming method and device, in which the condition around apertures through which toners pass can be constantly maintained in a state with little toner powder stuck thereto, whereby stable and favorable image formation becomes possible.

In order to achieve the above said object, the image forming method according to the present invention consists in a method of forming an image using an image forming device having, at least in the following order, a developer holding means that holds and conveys a charged developer, a plurality of developer passing apertures through which the developer is passed, a developer passing controller for controlling passing of the developer that is fed from the developer holding means in accordance with image signals inputted from outside, and an image receiver on which the developer that has passed through said apertures is received, and includes a process of cleaning, wherein the developer that is held on said developer holding means is caused to reach the vicinity of said developer passing apertures at least once, by inputting a predetermined signal to said developer passing controller, during a period when no image forming operation in accordance with prescribed image signals is performed.

It is preferable to cause the developer that has reached the vicinity of the developer passing apertures to pass through said developer passing apertures.

It is desirable that the developer that has passed the developer passing apertures is sucked through the developer passing controller by a developer sucking means positioned opposite to the developer holding means.

Further, it is preferable that the developer sucking means comprises a means for sucking the developer with an air current.

Alternatively, the developer sucking means may comprise a means for sucking the developer by forming an electric field.

The image receiver is preferred to be either an endless belt or a drum which moves in rotation and a developer image formed on the image receiver is transferred onto a recording sheet by a transfer means.

Further, it is desirable that the transfer means is brought apart from the surface of the image receiver at least during the cleaning process.

Further, it is desirable that the developer that has passed through the developer passing apertures during the cleaning process and landed on the image receiver that moves in rotation is removed from the image receiver by a developer remover which is in contact with the image receiver.

Also, it is preferable that the cleaning process is performed during a prescribed period after one image forming action is completed and before next image forming action is started in the case of performing image forming actions to a plurality of image receivers in succession.

Further, it is preferable that the image receiver is a recording sheet, and is held on an image receiver conveying means that moves in rotation at a position opposite to the developer passing controller.

It is desirable that the developer that has passed through the developer passing apertures during the cleaning process and landed on the image receiver conveying means which moves in rotation is removed from the image receiver conveying means by a developer remover which is in contact with the image receiver conveying means.

Furthermore, it is preferable that the cleaning process is performed during a prescribed period after completion of an operation for removing paper that has been jammed in the image forming device and before the image forming action is restarted.

Alternatively, the cleaning process may be performed by interrupting printing operation each time a predetermined number of printing has been completed, in the case of performing image formation to a plurality of image receivers in succession.

Also, the cleaning process may be performed during a prescribed period after a power supply of the image forming device is switched on and before an image forming operation is started.

An image forming device for implementing such method according to the present invention comprises: a charging device for providing a developer with charges to form a charged developer; a developer holding means for holding and conveying said charged developer; a backside electrode means for receiving said charged developer either directly or indirectly; an aperture electrode means disposed between said developer holding means and backside electrode means, having a plurality of developer passing apertures and control electrodes that are independently formed at least partly either inside the developer passing apertures or on the periphery of said developer passing apertures; and a cleaning voltage supply means for applying a voltage to said control electrodes, the voltage being high enough to cause the charged developer to leave said developer holding means and to reach the vicinity of said developer passing apertures.

The voltage applied to the control electrodes by said cleaning voltage supply means is preferred to be high enough to cause the charged developer not only to reach the developer passing apertures but also to pass through said developer passing apertures.

In order to achieve the above object, another image forming method according to the present invention consists in a method of forming images by using an image forming device having, at least in the following order, a developer holding means that holds and conveys a charged developer, a plurality of developer passing apertures through which the developer is passed, a developer passing controller for controlling passing of the developer that is fed from the developer holding means in accordance with image signals inputted from outside, and an image receiver on which the developer that has passed through said apertures is received, and comprises the steps of: a first cleaning process wherein the developer that is held on said developer holding means is caused to reach the vicinity of said developer passing apertures, by inputting a predetermined signal to said developer passing controller, during a period when no image forming operation in accordance with said image signals is performed; and a second cleaning process wherein the developer in the vicinity of the developer passing apertures is caused to reach said developer holding means.

The first cleaning process and said second cleaning process are preferred to be repeated alternately.

An image forming device for implementing such method according to the present invention comprises: a charging device for providing a developer with charges to form a charged developer; a developer holding means for holding and conveying said charged developer; a backside electrode means for receiving said charged developer either directly or indirectly; an aperture electrode means disposed between said developer holding means and backside electrode means, having a plurality of developer passing apertures and control electrodes that are independently formed at least partly either inside the developer passing apertures or on the periphery of said developer passing apertures; and a cleaning voltage supply means for successively applying a voltage to said control electrodes high enough to cause the charged developer to leave said developer holding means and to reach the vicinity of said developer passing apertures, and a voltage high enough to cause the charged developer to leave the vicinity of said developer passing apertures and to reach said developer holding means.

Other and further objects, features and advantages of the invention will appear more fully from the following description.

DETAILED DESCRIPTION OF PREFERRED EMBODIMENTS

Figure 1:
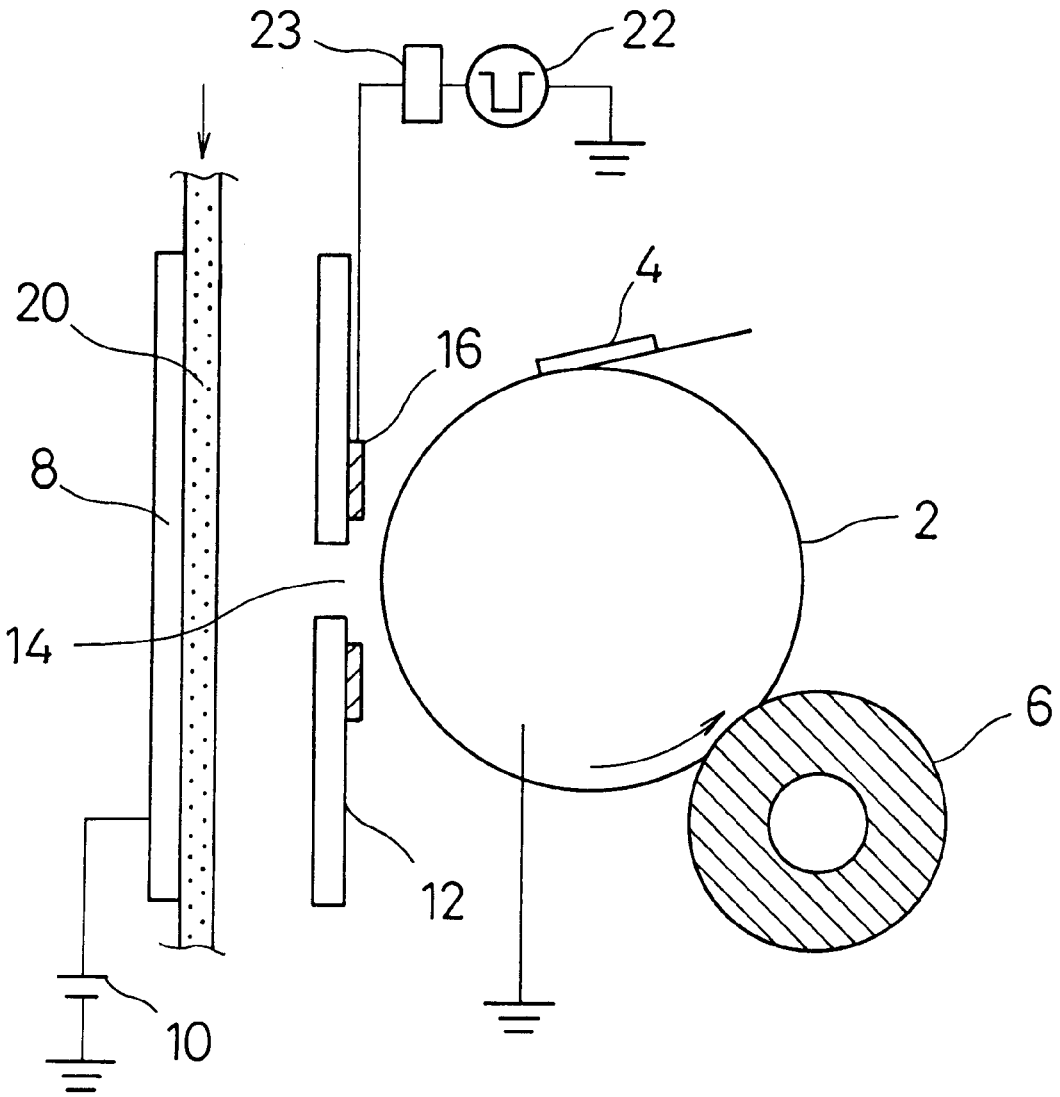
FIG. 1 is a cross-sectional view showing the principles of an image forming device according to one embodiment of the present invention.

One embodiment of an image forming device according to the present invention is described below with reference to the accompanying drawings. FIG. 1 is a cross-sectional view showing the principles of this image forming device. In FIG. 1, a developer roller 2 as a developer holding means is constructed of metal such as aluminum and iron or alloy and conveys charged particles known in the art as toners (developer). Aluminum cylinder having an outer diameter of 20 mm and 1 mm thickness is used for the developer roller 2, this being earthed, in this embodiment, but the construction is not limited to this and a direct current or alternating current voltage may be applied to the developer roller 2. Doctor blade 4 consists of a resilient member such as urethane rubber having hardness of 40 to 80 degrees according to Japanese Industrial Standards K6301 A scale, and a free end length (length of a portion jutting out from an attachment member) of 5 to 15 mm, and functions to form one to three layers of toner particles on the developer roller 2. Doctor blade 4 may be used in an electrically floating condition or may be earthed, or biased to a direct current or alternating current voltage. In this embodiment the blade 4 is used in a floating condition. Toners pass through between the developer roller 2 and doctor blade 4, where they are slightly agitated and thereby receive charges from the developer roller 2 and becomes electrified. In this embodiment, toners are charged negatively.

Feeding roller 6, which assists electrification of toners as well as controls feeding thereof, includes a metal shaft of iron or the like having about 2–6 mm thick layer of synthetic rubber such as urethane foam cast thereabout (its diameter being 8 mm in this embodiment), and has hardness of 30 degrees (measured after being formed into a roller shape according to the method of Japanese Industrial Standards K6301 A scale). It is preferable to arrange the feeding roller 6 such as to bite into the developer roller 2 in a range of 0.1 to 2 mm thickness. Feeding roller 6 may be earthed, or a direct current or alternating current voltage may be applied thereto.

An electric field is generated between a backside electrode 8 (backside electrode means) and the developer roller 2 by applying a voltage to the backside electrode 8 by means of a power supply 10. Backside electrode 8 may be constructed of a metal plate, conductive roller, or a resin film in which conductive fillers are dispersed, and preferably has a resistance of approximately $10^2$ to $10^{10}$ Ω/cm. Image recording is effected by causing toners to adhere directly onto the backside electrode 8, or, through a recording sheet 20 placed on the backside electrode 8. In the case of forming the backside electrode 8 in a film-like endless belt as described above, the construction may be such that a toner image is recorded directly on this endless belt, which in turn is transferred to the recording sheet. Appropriate spacing in the range 50 to 1000 μm, preferably, should be provided between the backside electrode 8 and aperture electrode 12, which will be described later in detail. Also, it is preferable that the developer roller 2 is either in direct contact with the aperture electrode 12, or is retained in a close vicinity thereof within the distance shorter than 100 μm.

FIG. 1 shows the case where a recording sheet 20 is used as an image receiver, and images are recorded on this recording sheet 20. Backside electrode 8 is constructed of a metal plate and fixed in position. Recording sheet 20 is fed onto the backside electrode 8 by a conveyor (not shown) in a direction shown by the arrow. A group of openings 14 (developer passing apertures) formed in an insulating film and a group of control electrodes 16 constitute the aperture electrode 12 (aperture electrode means). Aforementioned groups of openings 14 and control electrodes 16 are disposed in rows from the foreground side to the background side in FIG. 1, which is a cross-sectional view and thus shows only one respective opening and control electrode. Above-mentioned insulating film is preferably made of polyimide, polyethylene terephthalate or the like, and has an appropriate thickness of about 10 to 100 μm.

Figure 2A:
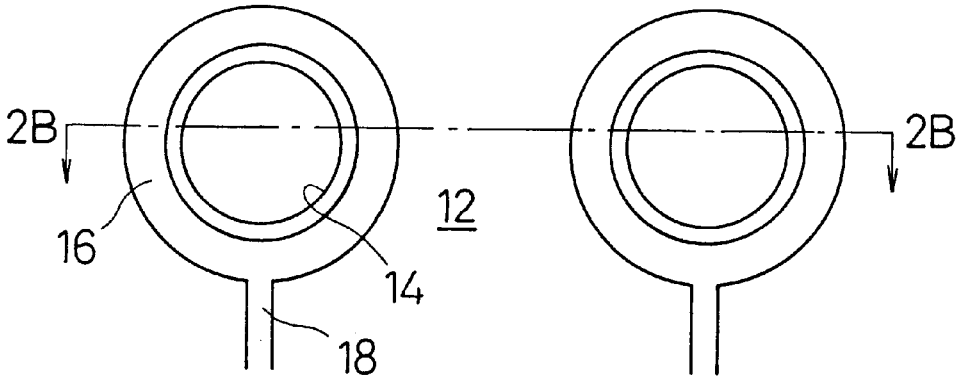
FIG. 2A is a front view and FIG. 2B is a cross-sectional view at line 2B—2B of FIG. 2A, both showing an aperture electrode in the embodiment of the present invention.
Figure 2B:
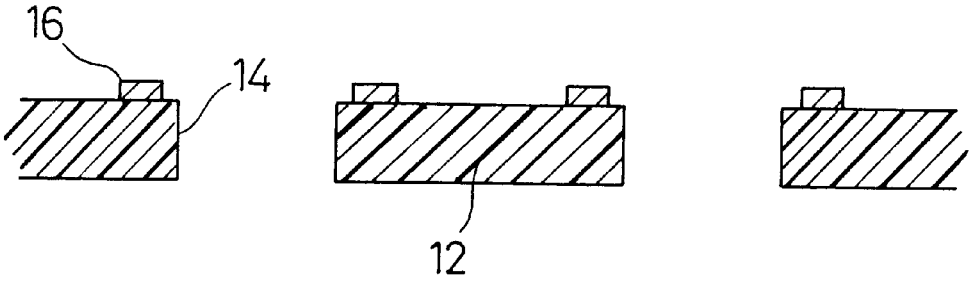

FIG. 2A is a front view of the aperture electrode 12 and FIG. 2B is a cross-sectional view thereof. Control electrodes 16 are formed in a ring-shape such as to surround the periphery of each opening 14, as shown in FIG. 2A. The construction of control electrodes 16 is not limited to this and they may be provided on the inner wall of the openings 14. Reference numeral 18 in FIG. 2A represents a lead which is formed as a part of patterns on the insulating film for connecting the control electrodes 16 to a control power supply 22. Each control electrode 16 is provided on its surface with 1 to 2 μm thick resin layer (not shown).

Although it is shown in FIGS. 2A and 2B such that the openings 14 are distanced with each other, they are actually disposed closely in a zigzag pattern so as to mutually cover the space between them, so that, when toners are blown out from all of the openings 14 for recording, an image of entirely solid black can be formed. The diameter of the openings 14 is preferred to be in the range of 50 to 200 μm. In this embodiment, the control electrodes 16 have an inner diameter of 150 μm, whereas the inner diameter of the openings 14 is 120 μm. Control electrodes 16 are constructed of metal such as copper and, preferably, have a 5 to 30 μm thickness. Each of the control electrodes 16 is individually connected through the leads 18 to the control power supply 22.

Control power supply 22 comprises a voltage generator (not shown) and elements for switching the voltage. One switching element has 32, 64, or 128 channels, each for controlling the voltage applied to the control electrodes 16 through the leads 18. For example, in the case of recording with a recording density of 300 dots per 1 inch (300 dpi), if a switching element having 64 channels is used, five switching elements each having 64 channels are required for controlling 300 openings.

Figure 3:
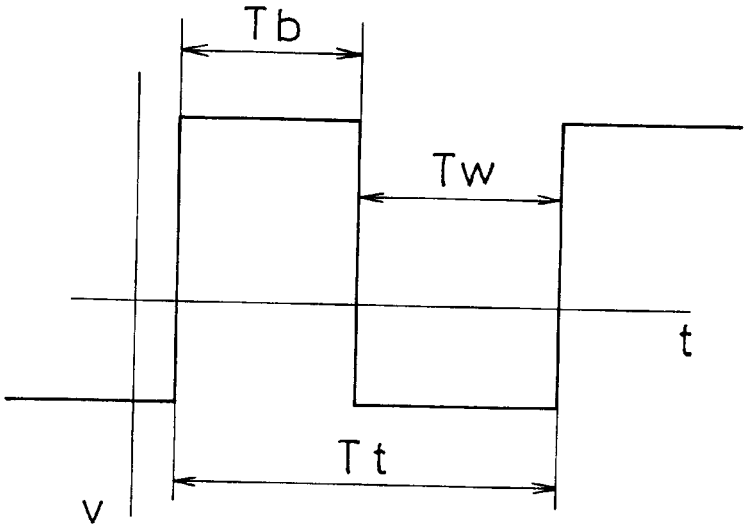
FIG. 3 is a wave form chart showing voltage application to control electrodes in the embodiment of the present invention.

FIG. 3 is a wave form chart showing application of voltage to the control electrodes 16, the vertical axis being voltage (v) and horizontal axis being time (t). Tt represents time required for forming one dot and is defined in accordance with resolution. By way of example, the diameter of one dot in the case of forming dots of 300 dpi(dot/inch) is about 83 μm, this being obtained by dividing one inch, that approximately equals to 25.4 mm, by 300 dots. Provided that the speed of recording sheet 20 is 60 mm/s, Tt or the time required for transfer of the recording sheet by the amount of one dot (83 μm) is calculated to be about 1390 μs. Tb must be set longer than the time required for the toners to leave the developer roller 2 and to reach the backside electrode 8. Specifically, this time is determined, with Tb being varied, by the time when the dot density becomes saturated. Tb in this embodiment was 200 μs. Tw that follows Tb shows the time during which an electric field is generated that suppresses leaving of the toners from the developer roller 2. Such electric field can be created by applying a voltage of the same polarity as that of the charged toners to the control electrodes 16. In this embodiment, since toners that have negative charges are used, a voltage of minus 100V is applied to the control electrodes 16. In accordance with the above example, since Tt=1390 μs, the voltage of −100V is applied for 1190 μs (Tw), i.e., the difference obtained by subtracting 200 μs (Tb) from 1390 μs (Tt).

Figure 4:
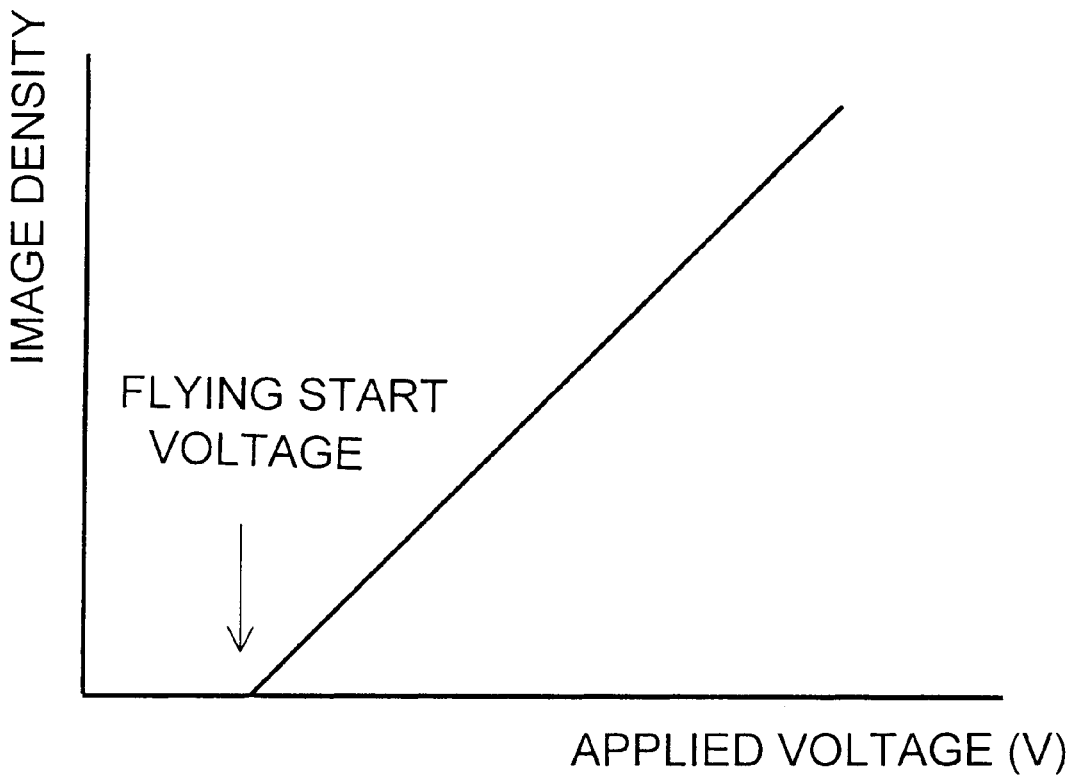
FIG. 4 is a graph showing flying start voltage, the horizontal axis being voltage applied to the control electrodes and the vertical axis being image density, in the embodiment of the present invention.

Cleaning power supply 23 is provided for applying a voltage that is higher than the flying start voltage shown in FIG. 4 but lower than the voltage during image formation, for example, +100V, to the control electrodes 16 during a non-image formation period. Flying start voltage is defined to be a voltage at which dot formation is started in the graph of which horizontal axis shows voltage applied to the control electrodes 16 and of which vertical axis shows image density of dots, under a certain fixed distance condition (such as the distance between the aperture electrode and developer roller). The reason why a voltage that is higher than the flying start voltage is impressed to the control electrodes 16 at least during cleaning so as to cause the toners on the developer roller 2 to fly is as follows.

In the case of using ring-shape control electrodes 16 as shown in FIGS. 2A and 2B, right sign toners (toners of negative polarity in this embodiment) that have not passed the openings 14 during the image forming operation are adhered to the ring-shape control electrodes 16. When the amount of these toners sticking to the control electrodes 16 is large, the above mentioned voltage application of the polarity opposite to that of the toners is not sufficient to cause the toners to return to the developer roller 2. Moreover, the layer of toners formed on the developer roller 2 contains wrong sign toners (toners of positive polarity in this embodiment), that are charged oppositely to the polarity these toners are initially supposed to have, and have a smaller absolute value of charges with respect to the right sign toners. These wrong sign toners contained in the toner layer on the developer roller 2 move onto the control electrodes 16 when the electric field is created between the control electrodes 16 and developer roller 2 during Tw. As a result, on the control electrodes 16 are accumulated right sign toners and wrong sign toners that are electrically cohered to each other. Such cohesion of toners is hard to break since the toners of opposite polarities are stuck to each other not only by the suction of van der Waals forces but also electrically. Accordingly, as the body of cohered toners stuck on the control electrodes 16 increases in amount, the openings 14 get covered with toners and clogged up.

In order to cause this body of cohered toners to return smoothly towards the developer roller 2, the toners on the developer roller 2 are caused by the force of the electric field to collide with the toners adhered on the control electrodes 16. This method utilizing collision between the toners is effective for decreasing the influence of van der Waals forces, that greatly act on the toners as a force to stick to the control electrodes 16. When toners are made to collide with the body of cohered toners, the right sign toners and wrong sign toners are brought apart, upon which the electrostatic force, which was acting as a suction force between both toner particles, decreases. Toners, once separated into individual particles, are recovered onto the developer roller 2 by means of the electric field of opposite polarity formed between the control electrodes 16 and developer roller 2. A clogging of the openings 14 with the cohered toners is thereby prevented.

However, there are cases where application of voltage higher than the flying start voltage and lower than the voltage during image formation to the control electrodes 16 to an extent such as to cause toners on the developer roller 2 to reach the control electrodes 16 at least once during the cleaning process is still not sufficient. In such a case, it is preferable to cause the toners not only to fly off from the developer roller 2 but also to pass through the openings 14 for the following reasons.

Specifically, after a number of image forming actions has been repeated, right sign toners that could not reach the backside electrode 8 get accumulated on the inner walls of the openings 14. Furthermore, in the case where a large amount of wrong sign toners (toners of positive polarity in this embodiment) is mixed in the toner layer on the developer roller 2, these wrong sign toners fly towards the control electrodes 16 and stick not only on the control electrodes 16 but also on the inner walls of the openings 14, when a voltage of the same polarity as that of the toners is applied to the control electrodes 16 during Tw. In this way, right sign toners and wrong sign toners are mixedly present on the inner walls of the openings 14 where they adhere thereto as a body of cohered toners similarly as described above. Such cohered toners cause the clogging of the openings 14. Moreover, when a voltage is applied to the backside electrode 8, the toners stuck on the inner walls of the openings 14 are sucked towards the backside electrode 8 by the electric field formed by the backside electrode 8, and these toners land on the recording sheet 20 leading to a so-called background noise.

Such problem cannot be solved solely by application of a voltage higher than the flying start voltage to the control electrodes 16 during the cleaning process, since the toners on the developer roller 2 can hardly reach the toners adhered to the inner walls of the openings 14, and a cleaning effect cannot be achieved. Such effect can only be expected by causing the toners not only to fly off from the developer roller 2 but also to pass through the openings 14, whereby the body of cohered toners on the inner walls of the openings 14 is disentangled. Moreover, toners passing through the openings 14 can help remove the toners adhered to the inner walls of the openings 14 together therewith, whereby it is possible to reduce the amount of toners stuck to the inner walls of the openings 14. In the above described case, it is preferable to apply a voltage to the control electrodes 16 higher than the flying start voltage, for example, to the same extent as the voltage applied when forming images, i.e., +200V, approximately.

Although a separate cleaning power supply 23 is provided as a cleaning voltage supply means apart from the control power supply 22 in the above embodiment, it is to be noted that the control power supply 22 can also double as a cleaning voltage supply means. In other words, the same effects as those in the above described embodiment will be achieved if image signals are inputted from the control power supply 22 to all of the control electrodes 16 several times during the cleaning process, thereby causing the toners to leave the developer roller 2 and to fly towards the backside electrode 8 through the openings 14.

Figure 5:
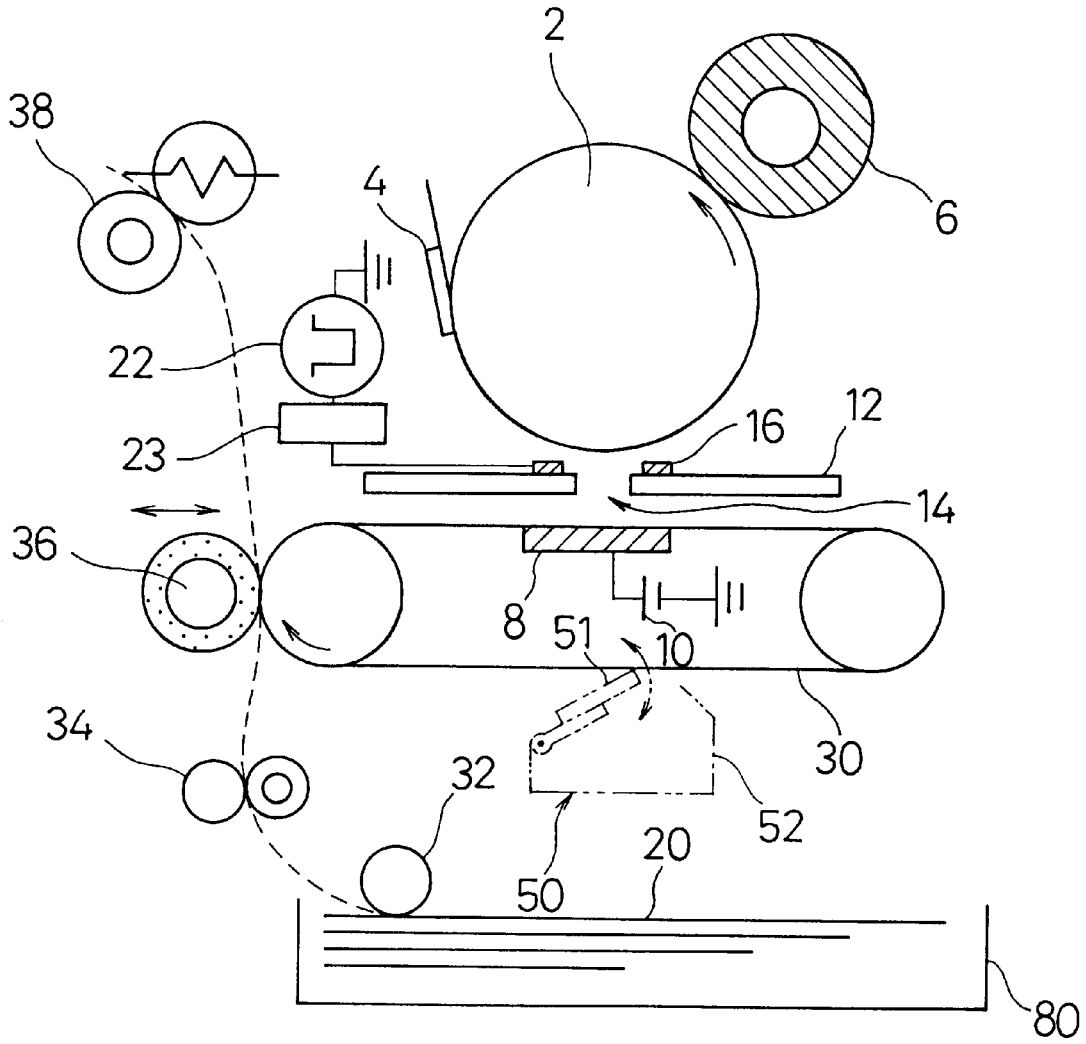
FIG. 5 is a schematic illustration of device construction given in explanation of the operation in another embodiment of the present invention.

Next, an image forming device according to another embodiment will be explained with reference to FIG. 5. FIG. 5 is a schematic illustration showing the construction of the device. In FIG. 5, an endless belt 30 as an intermediate image bearing member (image receiver) is constructed of a film made of resin in which conductive fillers are dispersed, and has resistance of $10^{10}$ Ω/cm. The backside electrode 8 is disposed such as to be in contact with the endless belt 30 from the backside thereof in a position opposite to the openings 14 of the aperture electrode 12. Pick-up roller 32 feeds the recording sheets 20 from a feeder tray 80 one at a time, timing roller 34 adjusts the position of the recording sheet 20 that is fed thereto and the image formed thereon, and transfer roller 36 (transfer means) functions to transfer the toner image formed on the endless belt 30 onto the recording sheet 20. The transfer roller 36 comprises a metal roller around which a foam sponge such as urethane processed to have conductivity is cast, having an outer diameter of 20 mm and hardness of about 30 degrees according to Japanese Industrial Standards K6301 A scale, and being pressed onto the endless belt 30 with a pressure of about 500–1000 g at both ends of the metal shaft. The resistance of the transfer roller 36 in this embodiment was about $10^{6}$–$10^{7}$ Ω, when pressed against an earthed metal plate with the above said pressure and a voltage of 500V was applied to the metal shaft.

The transfer roller 36 is constructed such that it is brought out of contact with the endless belt 30 as an intermediate image bearing member at least during the cleaning process.

The toner image transferred onto the recording sheet 20 is fused by a fixing device 38 with pressure and heat. Fixing of toners to recording sheets 20 is accomplished by heating and thereby fusing the toners made of resin into the sheet in this embodiment, and therefore, for the resin used as the toners, styrene-acrylic copolymer, styrene-butadiene copolymer, polyester resin, epoxy resin, and a combination thereof may be preferably used. Of course, magnetic toners containing a magnetic powder may also be used, in which case iron such as ferrite, magnetite, or alloy that contains ferromagnetic elements such as cobalt or nickel, or a compound may be effective. Magnetic powder is preferred to have appropriate coercivity of 100 to 5000 e, and may preferably be mixed with resin at the rate of 20–40 wt % with respect to 100 wt. of toner powder.

Furthermore, in order to control charges and toner fluidity, 0.1–5 wt. % of silicone dioxide ($SiO_2$), Titanium dioxide ($TiO_2$), metallic salt of stearic acid may be preferably added. Specifically, silicone dioxide greatly affects fluidity of toners, and therefore, a clogging of the openings 14 with toners can be avoided by addition thereof. Moreover, since silicone dioxide has a small diameter and has high charge, it is strongly attracted by an electric force and easily adhered to the wall surface of the openings 14. Therefore, silicone dioxide acts as runners for promoting the movement of toners passing through the openings 14, thereby preventing clogging. The specific surface area according to BET nitrogen adsorption method of silicone dioxide is preferred to be in a range 100–300 $m^2/g$. If silicone dioxide of a small diameter having the specific surface area smaller than 100 $m^2/g$ is used, the silicone dioxide is mixed with resin such as to cut the resin into pieces, as a result of which the fixing property is decreased.

Furthermore, as shown by a phantom line in FIG. 5, a developer remover 50 is provided for removing toners that have passed through the openings 14 during the cleaning process, landed on the belt and adhered thereon. It is specifically effective to provide such developer remover in a case in the device shown in FIG. 5 where a voltage applied to the backside electrode 8 for cleaning is of same polarity and to the same extent as that of the voltage applied for image formation, in which case a large amount of toners pass through the openings 14 and land on the endless belt 30.

The developer remover 50 comprises a blade 51 made of rubber or the like for scraping off toners and a toner recovery box 52, wherein the blade 51 is constructed such as to be capable of rocking so that it is contacted with the endless belt 30 only during the cleaning process.

Next, the actions of the device will be described. By way of example, if the resolution is 300 dpi, the aperture electrode 12 has 300 openings 14 per one inch that are disposed in a widthwise direction of sheets (from the foreground side to the background side in FIG. 5) in a position substantially opposite to the backside electrode 8. Control electrodes 16 are respectively formed to each of the openings 14 as has been shown in FIGS. 2A, 2B and respectively connected to the switching element through leads. Voltage is applied in a wave form as shown in FIG. 3 to each control electrode 16 in accordance with image data, whereby toners are transferred to the endless belt 30 as an intermediate image bearing member and image formation is accomplished. In this embodiment, the distance between the developer roller 2 and aperture electrode 12 is approximately 50 μm, the aperture electrode 12 and backside electrode 8 are spaced with each other with an interval of about 150 μm, and a voltage of about +100V is preliminarily applied to the backside electrode 8. The toner image formed on the endless belt 30 is transferred onto the recording sheet 20 that has been fed in synchronism with the toner image by means of the transfer roller 36 by applying a voltage of about +500V from the backside of the recording sheet 20. The toner image that is transferred onto the recording sheet 20 is then fused by the fixing roller 38, and discharged to the outside of the device.

Figure 6A:
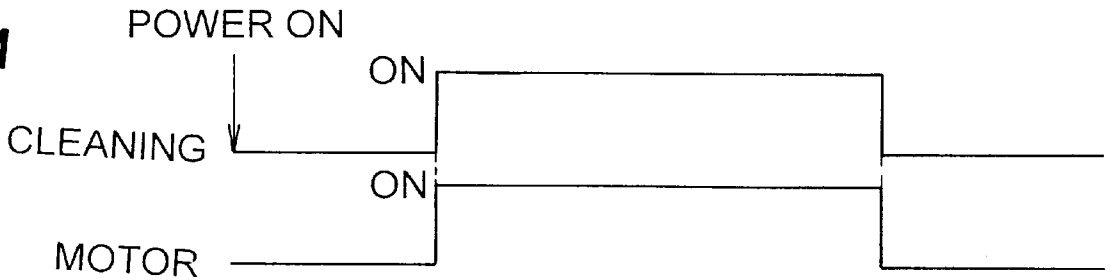
FIGS. 6A and 6B are timing charts for explaining a cleaning operation.

This series of actions will be explained with reference to the timing chart of FIGS. 6A and 6B. FIG. 6A shows the actions performed prior to the printing operation, when power is switched on, or, when recovering after paper jam or the like. In FIG. 6A, "CLEANING" shows the timing when cleaning is performed by applying a voltage higher than the flying start voltage, for example, +200V, to the control electrodes 16, and "MOTOR" shows the timing when the motor for effecting rotation of the developer roller 2 and endless belt 30 as an intermediate image bearing member is switched on. Initially, the cleaning and motor are simultaneously started and ended. This period was about one minute in this embodiment, but may be arbitrarily set.

Figure 6B:
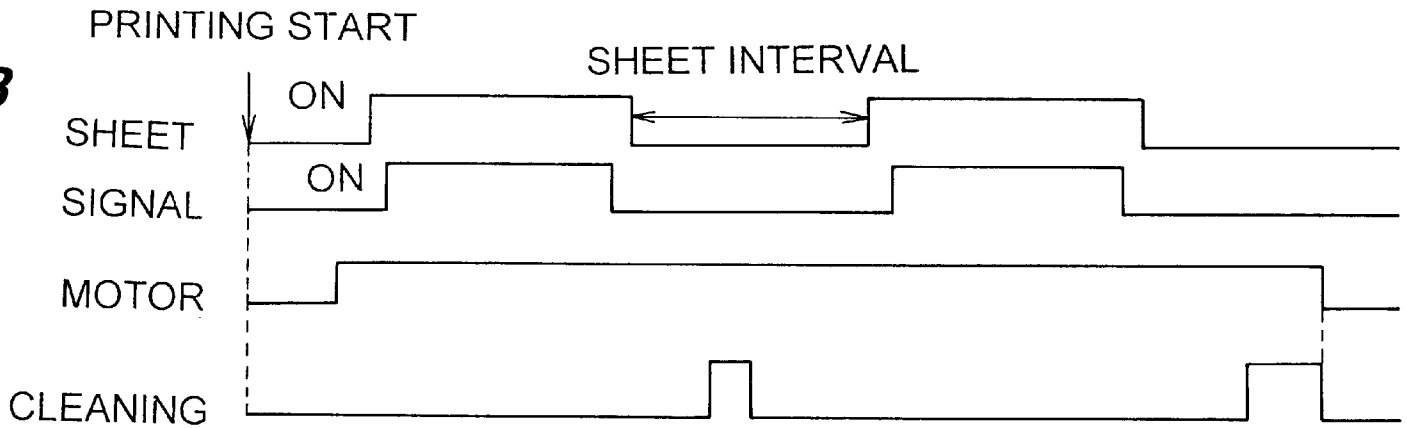
Figure 7:
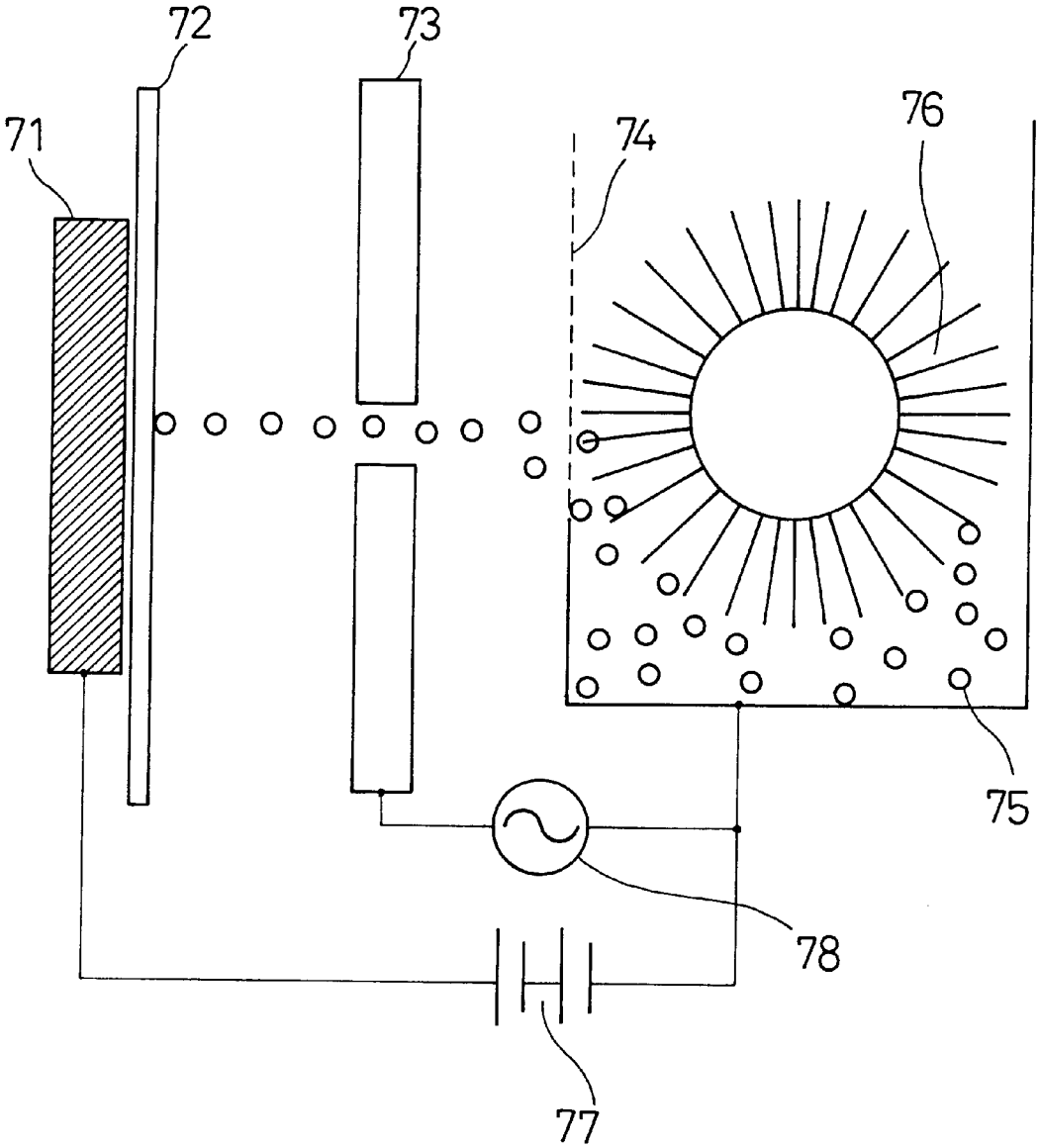
Fig. 7 Prior Art
FIG. 7 is a schematic illustration showing the construction of one conventional image forming device.
Figure 8:
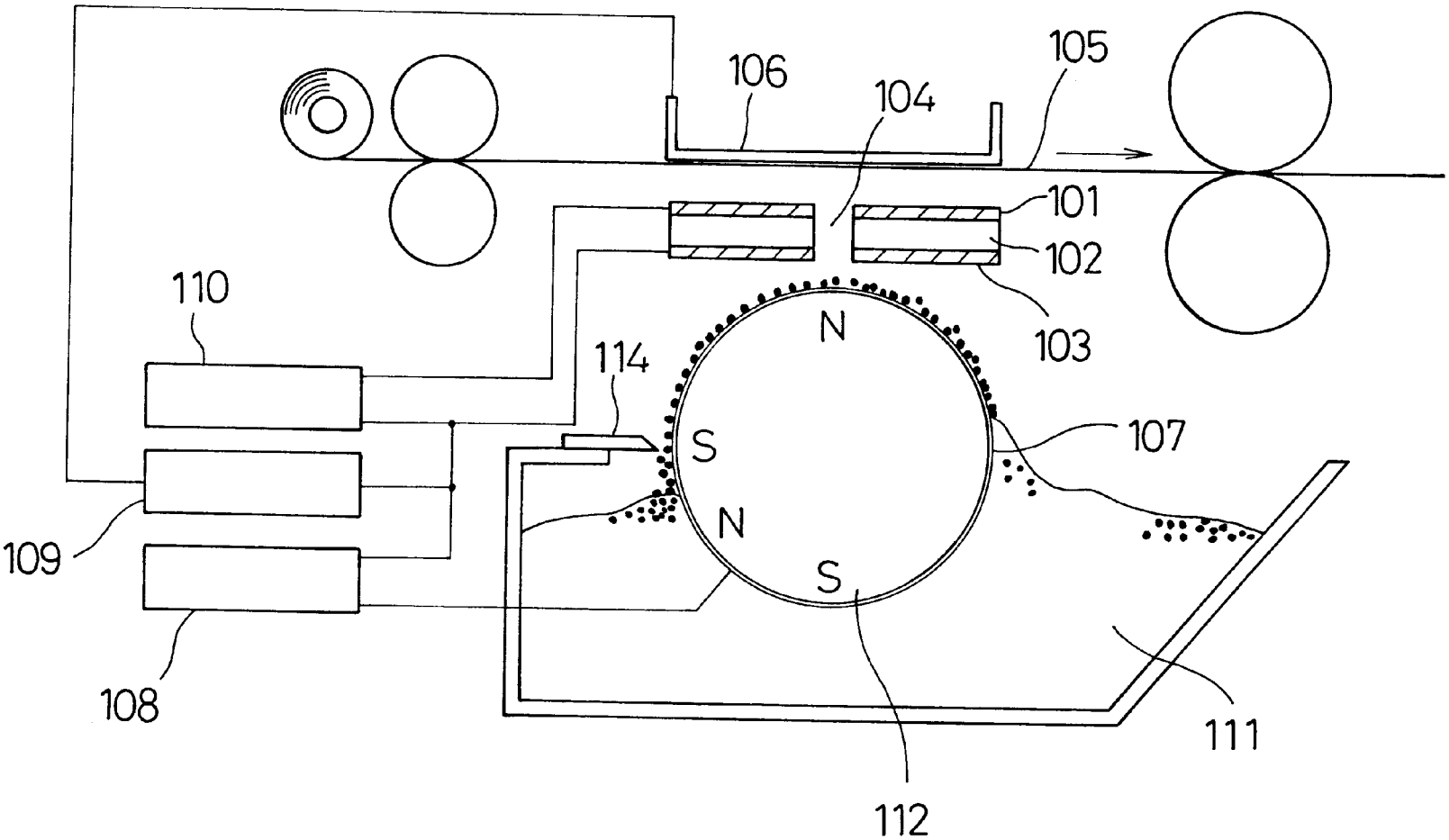
Fig. 8 Prior Art
FIG. 8 is a schematic illustration showing the construction of another conventional image forming device.

FIG. 6B shows the sequence in the case of performing printing to two sheets in succession. "CLEANING" and "MOTOR" in FIG. 6B have the same meanings as those in FIG. 6A. "SHEET" shows the timing of feeding the recording sheets, and "SIGNAL" shows the timing of sending image signals. In this case, cleaning is performed at intervals between sheets where there is no recording sheet 20, and after printing is completed. Printing and motor are stopped in synchronism with each other. In this embodiment, sheet interval was about 5 seconds, and cleaning action was performed for about 10 seconds after the completion of printing.

The above described cleaning process is also performed when the device is recovered to be in a condition capable of printing after the occurrence of paper jam, similarly as the above described initial actions shown in FIG. 6A. Also, when printing is made to a great number of sheets in succession, the printing action may be interrupted after printing of a predetermined number of sheets, and similar cleaning action as the initial actions is performed. In such a case, the number of printing needs to be counted by a central operator or the like.

In this embodiment, toners held on the developer roller are caused to reach the vicinity of openings 14 by inputting a different signal than image signals to the control electrodes only once during the period when no image forming operation in accordance with prescribed image signals is performed. However, the signals for effecting cleaning action may be of course inputted several times. In other words, instead of applying one pulse of voltage as shown in FIG. 6A or 6B for the cleaning action, such pulse-like voltage application may be made several times during the same period of time.

Furthermore, by combining the above described procedure and the process wherein toners in the vicinity of the openings 14 are caused to reach the developer roller 2, cleaning can be accomplished in both cases where toners have positive charges and negative charges. For example, instead of applying one pulse of voltage as shown in FIG. 6A or 6B for the cleaning action, voltage may be applied repeatedly using a cleaning power supply 23 which generates a pulse-like plus and minus wave form.

Figure 9:
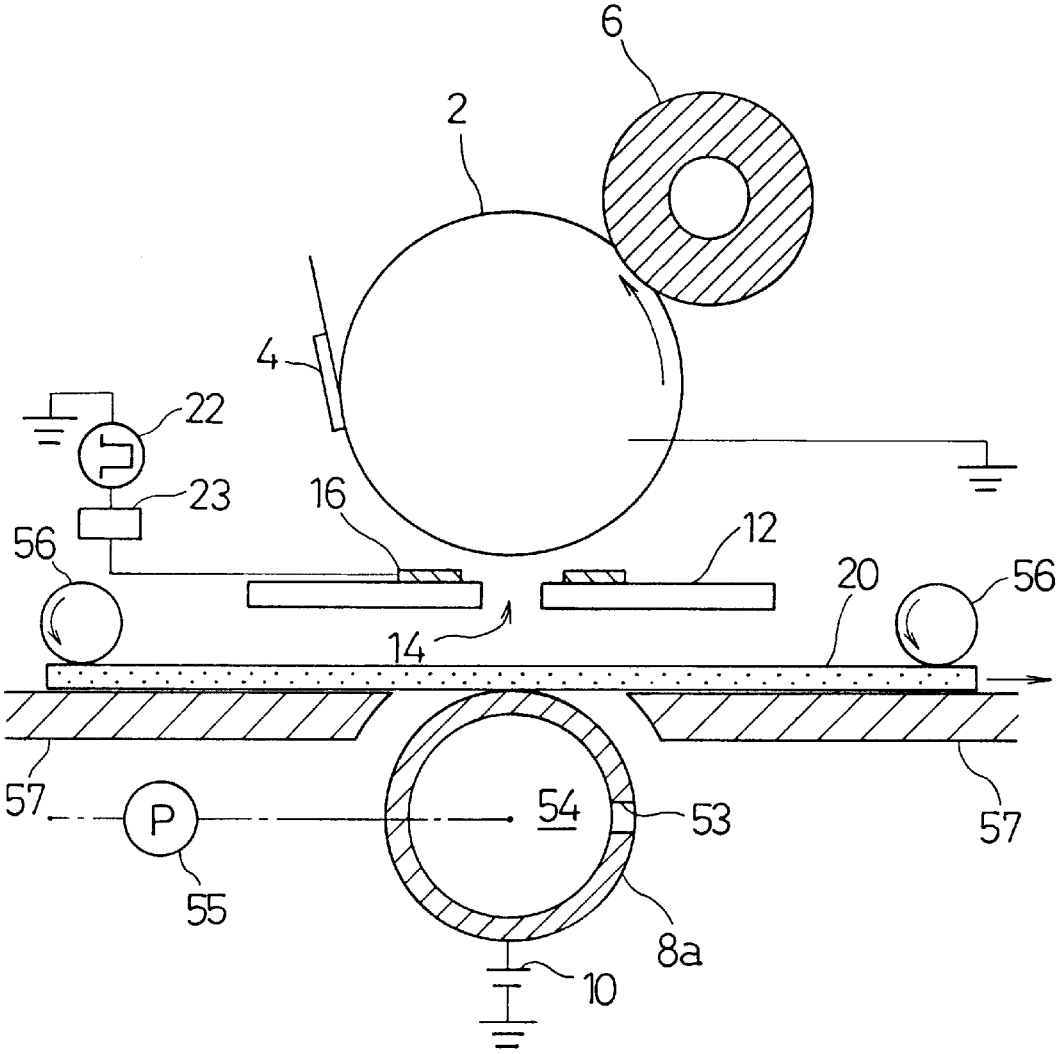
FIG. 9 is a schematic cross-sectional view showing a further embodiment of the present invention.
Figure 10:
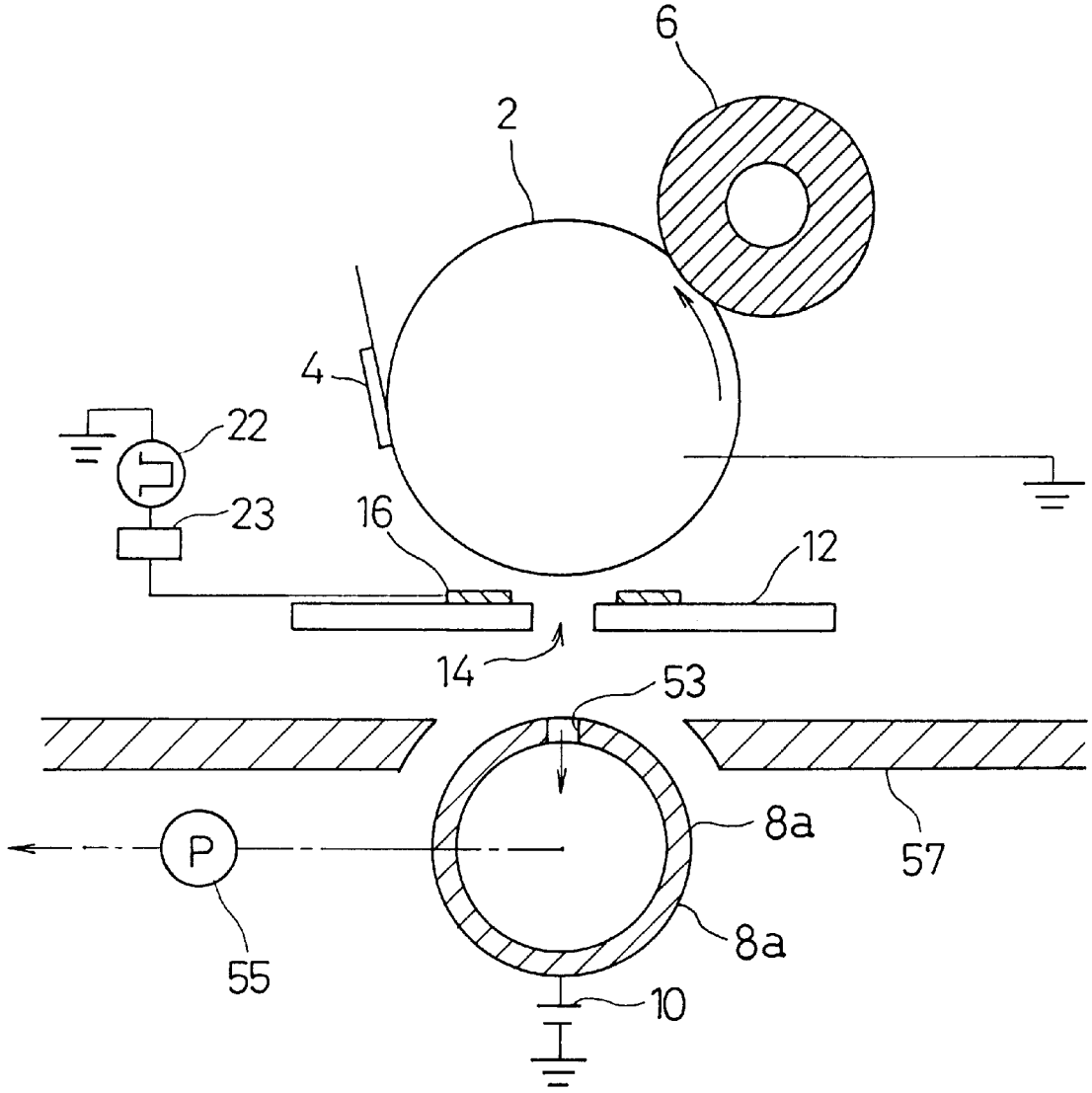
FIG. 10 is a cross-sectional view showing the cleaning process thereof.

FIG. 9 and FIG. 10 show another embodiment of the present invention. In this embodiment, a backside electrode 8*a* is constructed of a rotatable hollow roller and is provided with a slit 53 formed in an axial direction of the hollow roller. The inner space 54 of the hollow roller is connected to a discharge pump 55, whereby air is sucked into this inner space 54 and discharged through a filter (not shown) to the outside. Reference numeral 56 represents a conveyor roller for transferring the recording sheet 20 in a direction shown by the arrow, and 57 is a guide plate for guiding the recording sheet 20. Other constructions are the same as those of the previously described embodiment shown in FIG. 1, common reference numerals are used, and the descriptions thereof will be omitted.

In this embodiment, at the time of image forming operation, the backside electrode 8*a* (hollow roller) is positioned at a certain rotating position such that the slit 53 is off from the recording sheet 20 as shown in FIG. 9. On the other hand, at the time of cleaning, the backside electrode 8*a* (hollow roller) is rotated to the position shown in FIG. 10, that is, to the position where the slit 53 comes to face the openings 14, and stopped. During the cleaning process, the discharge pump 55 is activated so as to generate an air current for sucking the toners that have passed through the openings 14 into the inner space 54 of the hollow roller.

As described above, a developer sucking means comprising the slit 53 and the discharge pump 55 is provided in this embodiment, whereby toners are sucked by means of an air current during the cleaning process. It is to be noted that in this embodiment, too, as in the case shown in FIG. 1 where the toners are sucked towards the backside electrode 8 by an electric field created by applying a voltage to the backside electrode 8, it is possible to construct a developer sucking means of a superior suctional force by combining the above described air current and the suctional force of an electric field.

Figure 11:
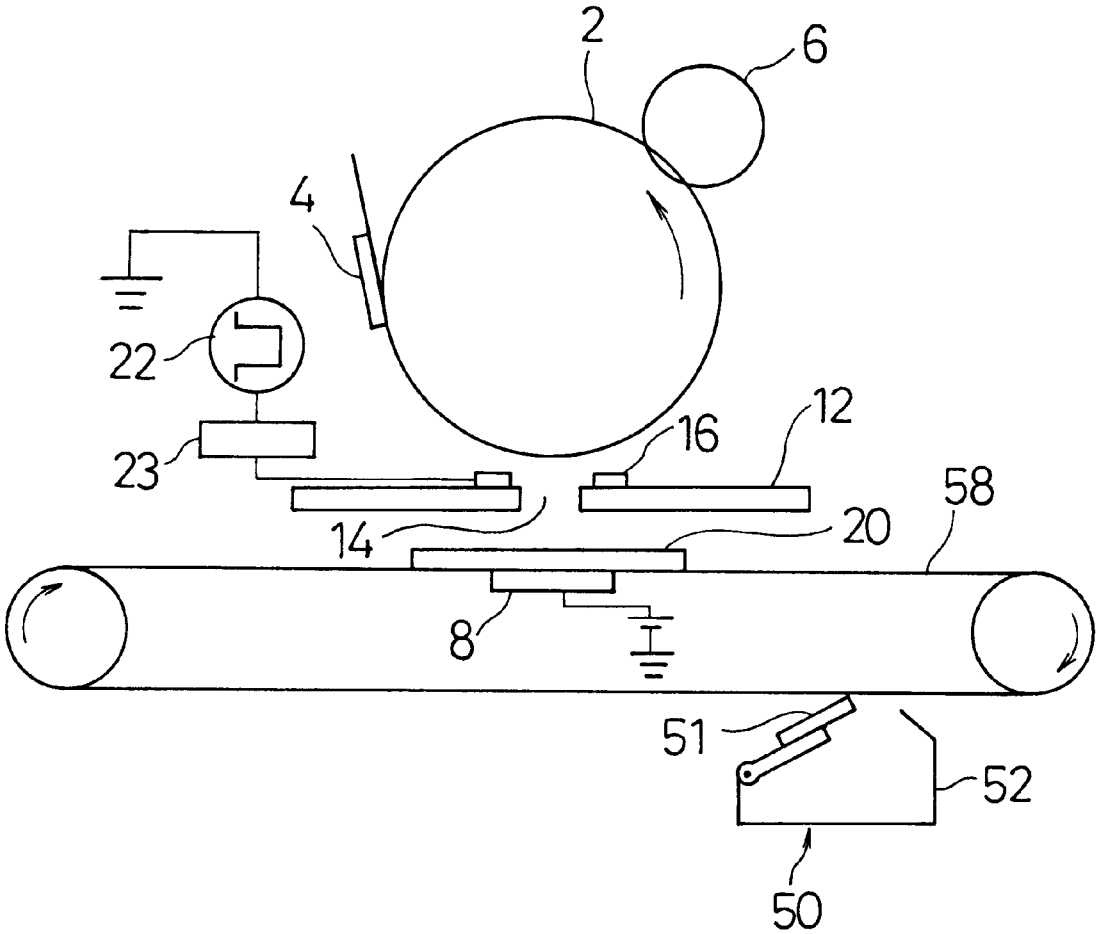
FIG. 11 is a schematic cross-sectional view showing a yet another embodiment of the present invention.

FIG. 11 shows a yet another embodiment of the present invention. This embodiment is basically constructed the same as the embodiment shown in FIG. 1, but is characterized in that a conveyor belt (image receiver conveying means) 58 that holds the recording sheet 20 as the image receiver and transfers the same, and a developer remover 50 for removing toners that have passed through the openings 14 during the cleaning process, landed on the conveyor belt 58 and adhered thereonto, are provided. The description of the developer remover 50 will be omitted as it is similarly constructed as in the case shown in FIG. 5. Common reference numerals are used for other constructions and descriptions thereof are also omitted, since these are similar to the case shown in FIG. 1.

Figure 12:
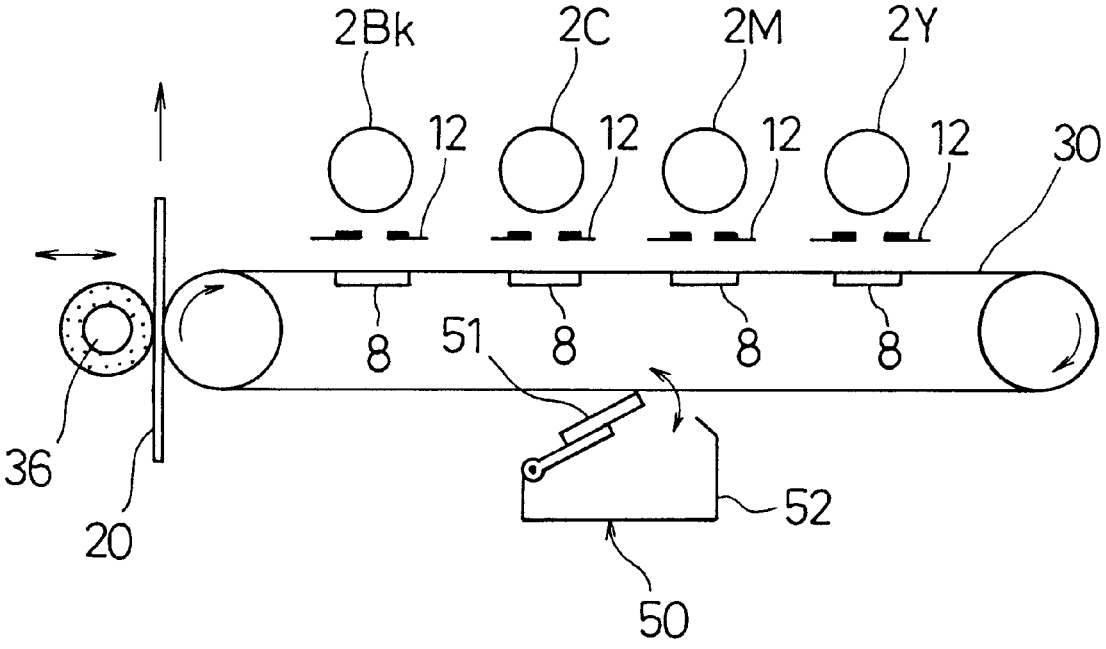
FIG. 12 is a schematic illustration showing the construction of another embodiment of the present invention applied to a color image forming device.

FIG. 12 shows another embodiment of the present invention which is applied to a color image forming device. This color image forming device comprises developer rollers 2Bk, 2C, 2M, 2Y for supplying black toners, cyan toners, magenta toners, and yellow toners, respectively, and corresponding aperture electrodes 12 and backside electrodes 8. The endless belt 30 as an intermediate image bearing member is passed between these aperture electrodes 12 and backside electrodes 8, on which toner images of each color are successively superposed on one another, forming a color toner image, that is then transferred onto the recording sheet 20 by means of the transfer roller 36.

Other specific constructions, image forming process, and cleaning process are similar to those of the case shown in FIG. 5, and the descriptions thereof will be omitted. The developer remover 50 shown in FIG. 5 is also provided in this embodiment.

Furthermore, in this embodiment, too, as has been explained with reference to the embodiment shown in FIG. 5, it is preferable to construct such that the cleaning process includes first and second cleaning steps, that is, in the first step the toners held on the developer rollers 2Bk, 2C, 2M, 2Y are caused to reach the vicinity of the openings of the aperture electrode 12 by inputting a signal different from the image signals for image formation to the control electrodes of the aperture electrode 12, and in the second step the toners in the vicinity of the openings are caused to return to the developer rollers 2Bk, 2C, 2M, 2Y.

Although the color image forming device shown in FIG. 12 is illustrated as an endless belt type, it is also possible to adopt a rotary structure wherein the intermediate image bearing member (image receiver) is constructed of a rotatable drum, around the outer periphery of which developer rollers of each color and aperture electrodes are disposed, and around the inner periphery of which backside electrodes are arranged such as to oppose respective aperture electrodes. The present invention can of course be applied to such type of color image forming device.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming method implemented by using an image forming device having, at least in the following order, a developer holding means that holds and conveys a charged developer, a plurality of developer passing apertures through which the developer is passed, a developer passing controller for controlling passing of the developer that is fed from the developer holding means in accordance with image signals inputted from outside, and an image receiver on which the developer that has passed through said apertures is received, including a process of:

cleaning, wherein the developer that is held on said developer holding means is caused to reach the vicinity of said developer passing apertures at least once, by inputting a predetermined signal to said developer passing controller, during a period when no image forming operation in accordance with prescribed image signals is performed.

2. The image forming method according to claim 1, wherein the developer that has reached the vicinity of the developer passing apertures pass through said developer passing apertures.

3. The image forming method according to claim 2, wherein the developer that has passed the developer passing apertures is sucked through the developer passing controller by a developer sucking means positioned opposite to the developer holding means.

4. The image forming method according to claim 3, wherein the developer sucking means comprises a means for sucking the developer with an air current.

5. The image forming method according to claim 3, wherein the developer sucking means comprises a means for sucking the developer by forming an electric field.

6. The image forming method according to claim 2, wherein the image receiver is either an endless belt or a drum which moves in rotation and a developer image formed on the image receiver is transferred onto a recording sheet by a transfer means.

7. The image forming method according to claim 6, wherein the transfer means is brought apart from the surface of the image receiver at least during the cleaning process.

8. The image forming method according to claim 6, wherein the developer that has passed through the developer passing apertures during the cleaning process and landed on the image receiver that moves in rotation is removed from the image receiver by a developer remover which is in contact with the image receiver.

9. The image forming method according to claim 1, wherein the cleaning process is performed during a prescribed period after one image forming action is completed and before next image forming action is started in the case of performing image forming actions to a plurality of image receivers in succession.

10. The image forming method according to claim 1, wherein the image receiver is a recording sheet, and is held on an image receiver conveying means that moves in rotation at a position opposite to the developer passing controller.

11. The image forming method according to claim 10, wherein the developer that has passed through the developer passing apertures during the cleaning process and landed on the image receiver conveying means which moves in rotation is removed from the image receiver conveying means by a developer remover which is in contact with the image receiver conveying means.

12. The image forming method according to claim 1, wherein the cleaning process is performed during a prescribed period after completion of an operation for removing paper that has been jammed in the image forming device and before our image forming action is restarted.

13. The image forming method according to claim 1, wherein the cleaning process is performed by interrupting printing operation each time a predetermined number of printing has been completed, in the case of performing image formation to a plurality of image receivers in succession.

14. The image forming method according to claim 1, wherein the cleaning process is performed during a prescribed period after a power supply of the image forming device is switched on and before an image forming operation is started.

15. An image forming device comprising:

a charging device for providing a developer with charges to form a charged developer;

a developer holding means for holding and conveying said charged developer;

a backside electrode means for receiving said charged developer either directly or indirectly;

an aperture electrode means disposed between said developer holding means and backside electrode means, having a plurality of developer passing apertures and control electrodes that are independently formed at least partly either inside the developer passing apertures or on the periphery of said developer passing apertures; and a cleaning voltage supply means for applying a voltage to said control electrodes, the voltage being high enough to cause the charged developer to leave said developer holding means and to reach the vicinity of said developer passing apertures.

16. The image forming device according to claim 15, wherein the voltage applied to the control electrodes by said cleaning voltage supply means is high enough to cause the charged developer not only to reach the developer passing apertures but also to pass through said developer passing apertures.

17. An image forming method implemented by using an image forming device having, at least in the following order, a developer holding means that holds and conveys a charged developer, a plurality of developer passing apertures through which the developer is passed, a developer passing controller for controlling passing of the developer that is fed from the developer holding means in accordance with image signals inputted from outside, and an image receiver on which the developer that has passed through said apertures is received, comprising the steps of:

a first cleaning process wherein the developer that is held on said developer holding means is caused to reach the vicinity of said developer passing apertures, by inputting a predetermined signal to said developer passing controller, during a period when no image forming operation in accordance with said image signals is performed; and a second cleaning process wherein the developer in the vicinity of the developer passing apertures is caused to reach said developer holding means.

18. The image forming method according to claim 17, wherein said first cleaning process and said second cleaning process are repeated alternately.

19. An image forming device comprising:

a charging device for providing a developer with charges to form a charged developer;

a developer holding means for holding and conveying said charged developer;

a backside electrode means for receiving said charged developer either directly or indirectly;

an aperture electrode means disposed between said developer holding means and backside electrode means, having a plurality of developer passing apertures and control electrodes that are independently formed at least partly either inside the developer passing apertures or on the periphery of said developer passing apertures; and a cleaning voltage supply means for successively applying a voltage to said control electrodes high enough to cause the charged developer to leave said developer holding means and to reach the vicinity of said developer passing apertures, and a voltage high enough to cause the charged developer to leave the vicinity of said developer passing apertures and to reach said developer holding means.

* * * * *